11/12/85 OR 4,551,920

United States Patent [19]

Mahotra

[11] Patent Number: 4,551,920

[45] Date of Patent: Nov. 12, 1985

[54] REAR SIGHT FOR FIREARMS

[75] Inventor: Satish K. Mahotra, Steyr, Austria

[73] Assignee: Steyr-Daimler-Puch Aktiengesellschaft, Vienna, Austria

[21] Appl. No.: 609,190

[22] Filed: May 11, 1984

[30] Foreign Application Priority Data

May 20, 1983 [AT] Austria ..... 1851/83

[51] Int. Cl.[4] ..... F41G 1/16

[52] U.S. Cl. ..... 33/257; 33/252; 33/254

[58] Field of Search ..... 33/257, 233, 254, 256, 33/252, 258, 259

[56] References Cited

U.S. PATENT DOCUMENTS 2,356,182 8/1944 Schaich ..... 33/257
3,626,597 12/1971 Darrah ..... 33/252
4,200,989 5/1980 Brouthers ..... 33/257

FOREIGN PATENT DOCUMENTS 1112426 8/1961 Fed. Rep. of Germany ..... 33/257

*Primary Examiner*—Willis Little
*Attorney, Agent, or Firm*—Karl F. Ross; Herbert Dubno

[57] ABSTRACT

A rear sight, particularly for a pistol, comprises a sight plate carrier and a sight plate, which is mounted in the sight plate carrier and is vertically and laterally adjustable. To provide a rear sight which is structurally simple and has small dimensions, the sight plate carrier is nonadjustably secured to the firearm, particularly at its breech, and is formed with a groove, in which the sight plate is guided for vertical and lateral movements. Two transverse adjusting screws extend from the end faces of the sight plate carrier into the latter and are screwed into the sight plate and serve for a lateral adjustment thereof. A vertical adjusting screw is provided, which crosses the transverse adjusting screws at right angles thereto and is adapted to be screwed into the firearm, particularly at its breech, and has a head, which extends into a slotlike opening formed in the sight plate.

7 Claims, 3 Drawing Figures

REAR SIGHT FOR FIREARMS

Figure 1:
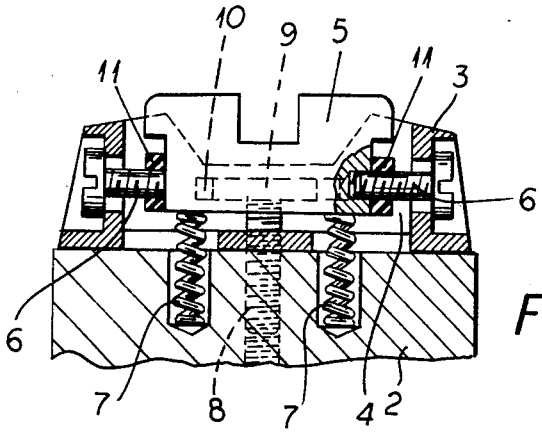

This invention relates to a rear sight for firearms, particularly for pistols, comprising a sight plate carrier and a sight plate which is mounted in said rear sight blade carrier and vertically and laterally adjustable.

Known rear sights for pistols comprise a sight plate, which is vertically and laterally adjustable and mounted in a sight plate carrier. The latter constitutes a slide, which is slidably mounted on an intermediate carrier, which is mounted on a base carrier that is adapted to be secured to the firearm, e.g., to the breech of the pistol. The intermediate carrier is adjustable relative to the base carrier in a direction which is normal to the direction in which the sight plate carrier is adjustable. Such mounting means for the sight plate are so bulky that they can be used only in sports pistols rather than in firearms used for protection. An improvement has been achieved in that in a rear sight in which the sight plate carrier is pivotally movable in a vertical direction the hinge for said sight plate carrier is mounted in a second carrier, which is adapted to be secured to the firearm, particularly at its breech, and the sight plate carrier is laterally displaceable relative to the second carrier. But that mounting arrangement is also relatively complicated and has large overall dimensions. Because strong shocks and impacts occur when a shot is fired, an unintended rotation of the adjusting screws of the rear sight must be prevented. This can be accomplished by spring-loaded ball detents, but these also add to the structural expenditure.

It is an object of the invention to eliminate the above-mentioned disadvantages and to provide a rear sight which is of the kind described first hereinbefore and which is simple in structure and relatively small in size so that it is of universal utility.

This object is accomplished in accordance with the invention in that the rear sight comprises a sight plate carrier, which is secured to the firearm, particularly at its breech, and is formed with a groove, the sight plate is mounted in said groove and is vertically and laterally slidable relative to the sight plate carrier in said groove, and the rear sight comprises two transverse adjusting screws, which are parallel to the groove and extend from the end faces of the sight plate carrier into the latter and are screwed into the sight plate, and a vertical adjusting screw, which crosses the transverse adjusting screws at right angles thereto and is adapted to be screwed into the firearm, e.g. into the breech of the firearm, and has a head extending into a slotlike opening formed in the sight plate.

In such an arrangement the sight plate is slidably adjustable in the sight plate carrier in the two directions in which an adjustment may be required, so that the sight plate carrier can be nonadjustably secured to the firearm, e.g., at its breech, no mounting element other than the sight plate carrier is required and the dimensions of the entire rear sight can be minimized. A lateral adjustment of the sight plate can easily be accomplished by means of the two transverse adjusting screws without a need for additional components. The vertical adjusting screw, which is screwed into the firearm, e.g., at its breech, and has a head entering a slotlike opening in the sight plate, constitutes a simple device for a vertical adjustment of the sight plate. It will be understood that the holes which are formed in the sight plate carrier at its end faces and receive the transverse adjusting screws must consist of slots which permit a vertical movement of the sight plate.

In order to ensure that manufacturing tolerances will be taken up and that the sight plate is vertically biased, the latter is urged by prestressed compression springs away from the bottom of the groove.

The structural expenditure involved in the rear sight should not be excessively increased by the means required to lock the screws in position. For this purpose, the shaft of each adjusting screw carries a lock washer, which is held against rotation and consists of elastically deformable material and has a threadless bore, which when the lock washer is relaxed has a diameter that is smaller than the root diameter of the shaft of the screw. At the rim of its threadless bore, such lock washer owing to its elasticity engages the shaft of the screw so firmly that the latter cannot be inadvertently rotated, particularly because the lock washer is also held against rotation. These lock washers are very simple, inexpensive parts and do not alter the overall design.

Figure 2:
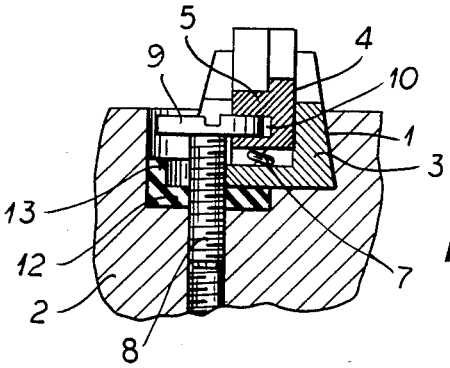
Figure 3:
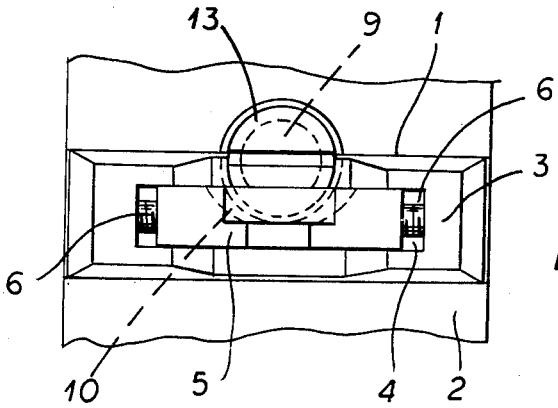

An embodiment of the invention is shown by way of example on the drawing, in which FIG. 1 is a sectional view showing the rear sight of a pistol and taken on a plane that is transverse to the direction of the barrel, FIG. 2 shows the rear sight in a sectional view taken on a plane that is parallel to the direction of the barrel and FIG. 3 is a top plan view showing the rear sight.

A piston is formed in a sight-carrying portion 2 at its breech with a dovetail groove 1, which receives a sight plate carrier 3, which is nonadjustably fixed in the groove 1, e.g., by being calked therein. The sight plate carrier 3 is formed with a groove 4, in which the sight plate 5 is vertically and laterally slidable. Two transverse adjusting screws 6, which are parallel to the groove 4, extend from the end faces of the sight plate carrier 3 into the latter and are screwed into the sight plate 5. Vertical compression springs 7 are prestressed between the sight plate carrier 3 and the bottom of the sight plate 5 and urge the latter upwardly. The transverse adjusting screws 6 extend through vertical slots formed in the end walls of the sight plate carrier 3. For a vertical adjustment of the sight plate 5, a vertical adjusting screw 8 is provided, which crosses the lateral adjusting screws 6 at right angles thereto and is screwed into the firearm at its breech 2. The vertical adjusting screws 8 has a flat, wide head 9, which extends into a slotlike opening 10 formed in the sight plate 5. Each of the transverse adjusting screws 6 carries a rectangular lock washer 11, which fits the groove 4 and consists of elastically deformable material and has a threadless bore. When the lock washer 11 is relaxed, the diameter of said bore is smaller than the root diameter of the shaft of the associated transverse adjusting screw 6. A similar lock washer 12 is carried by the vertical adjusting screw 8 and comprises a flange 13 bearing on the outside of the adjacent longitudinal wall of the sight plate carrier 3 to hold the lock washer 12 against rotation.

What is claimed is:

1. In a rear sight for a firearm, comprising a sight plate carrier having two mutually opposite end faces and an open-topped groove extending along said sight plate carrier between said end faces.

a sight plate, which is mounted in said groove and is guided in said groove for adjustment and along said groove and is vertically adjustable, two transverse adjusting screws, which are parallel to said groove and extend from respective ones of said end faces into said sight plate carrier and are screwed into said sight plate and operable to adjust said sight plate along said groove, and vertical adjusting means for vertically adjusting said sight plate, the improvement residing in that said sight plate is guided in said groove for a vertical adjustment in said groove, said sight plate is formed with a generally horizontally extending, slotlike opening, and said vertical adjusting means comprise a vertical adjusting screw, which crosses said transverse adjusting screws at right angles thereto and has a head extending into said slotlike opening and is adapted to be screwed into said firearm.

2. The improvement set forth in claim 1 as applied to a rear sight for a pistol.

3. The improvement set forth in claim 1, wherein prestressed compression spring means are provided between said sight plate carrier and said sight plate and urge said sight plate upwardly.

4. The improvement set forth in claim 1, wherein each of said adjusting screws has a screw-threaded shaft having a root diamter, and each of said adjusting screws carries a lock washer, which consists of elastically deformable material and has a threadless bore through which said shaft extends and which in a relaxed condition of said lock washer has a diameter that is smaller than the root diameter of said shaft, and said lock washer is held in said rear sight against rotation about said shaft.

5. In a firearm having a sight-carrying portion and a rear sight comprising a sight plate carrier carried by said sight-carrying portion and having two mutually opposite end faces and an open-topped groove extending along said sight plate carrier between said end faces, a sight plate, which is mounted in said groove and is guided in said groove for adjustment and along said groove and is vertically adjustable, two transverse adjusting screws, which are parallel to said groove and extend from respective ones of said end faces into said sight plate carrier and are screwed into said sight plate and operable to adjust said sight plate along said groove, and vertical adjusting means for vertically adjusting said sight plate, the improvement residing in that said sight plate carrier is nonadjustably secured to said sight-carrying portion, said sight plate is guided in said groove for a vertical adjustment in said groove, said sight plate is formed with a generally horizontally extending, slotlike opening and said vertical adjusting means comprise a vertical adjusting screw, which is screwed into said sight-carrying portion and crosses said transverse adjusting screws at right angles thereto and has a head extending into said slotlike opening.

6. The improvement set forth in claim 5 as applied to a firearm having a breech adjacent to said sight-carrying portion.

7. The improvement set forth in claim 5 as applied to a pistol.

* * * * *

UNITED STATES PATENT AND TRADEMARK OFFICE

CERTIFICATE OF CORRECTION

PATENT NO. : 4,551,920

DATED : 12 November 1985

INVENTOR(S) : Satish K. MALHOTRA

It is certified that error appears in the above-identified patent and that said Letters Patent is hereby corrected as shown below:

In the heading, left column, item [75], the correct name of the inventor should read:

-- Satish K. MALHOTRA -- .

Signed and Sealed this

*Eighteenth* Day of *February 1986*

[SEAL]

*Attest:*

DONALD J. QUIGG

*Attesting Officer*

*Commissioner of Patents and Trademarks*